United States Patent [19]

Vendramini

[11] Patent Number: 5,050,354

[45] Date of Patent: Sep. 24, 1991

[54] PREFABRICATED HOUSE INCLUDING MOLDED ELEMENTS

[76] Inventor: Dante Vendramini, 34, rue du Général Leclerc, 92270 Bois Columbes, France

[21] Appl. No.: 413,593

[22] Filed: Sep. 28, 1989

[30] Foreign Application Priority Data

Oct. 3, 1988 [FR] France ..... 88 12916

[51] Int. Cl.[5] ..... E04H 3/00

[52] U.S. Cl. ..... 52/80; 52/309.15

[58] Field of Search ..... 52/79.4, 80, 82, 86, 52/309.15, 73

[56] References Cited

U.S. PATENT DOCUMENTS

| | | | |
|---|---|---|---|
| 3,763,608 | 10/1973 | Chamlee | 52/80 |
| 3,999,337 | 12/1976 | Tomassetti, Sr. et al. . | |
| 4,023,317 | 5/1977 | Bettger et al. | 52/80 X |
| 4,265,059 | 5/1981 | Johnson | 52/73 X |
| 4,612,741 | 9/1986 | Jacobson | 52/79.4 |
| 4,784,172 | 11/1988 | Yacoboni | 52/80 X |

FOREIGN PATENT DOCUMENTS

| | | | |
|---|---|---|---|
| 038382 | 10/1980 | European Pat. Off. | 1/32 |
| 267784 | 11/1987 | European Pat. Off. . | |
| 2426122 | 5/1978 | France . | |
| 2130620 | 11/1982 | United Kingdom . | |

*Primary Examiner*—David A. Scherbel
*Assistant Examiner*—Creighton Smith
*Attorney, Agent, or Firm*—Charles E. Temko

[57] ABSTRACT

A prefabricated house comprises a plurality of adjacent radial molded elements ($10_1$ to $10_{18}$) which are assembled together to form a low dome. The house has a central support structure (12) in the form of a shaft erected on a floor slab (14) and each of the molded elements has an outer wall (42) formed by a sandwich of composite material and forming a part both of the roof and of the side wall of the house. The outer wall (42) is delimited by a top edge (44) for connection to the central support structure (12), a bottom edge (48) for connection to the floor slab (14), and two side edges (52, 54) for assembly to two corresponding side edges (56, 58) belonging to two adjacent elements.

9 Claims, 3 Drawing Sheets

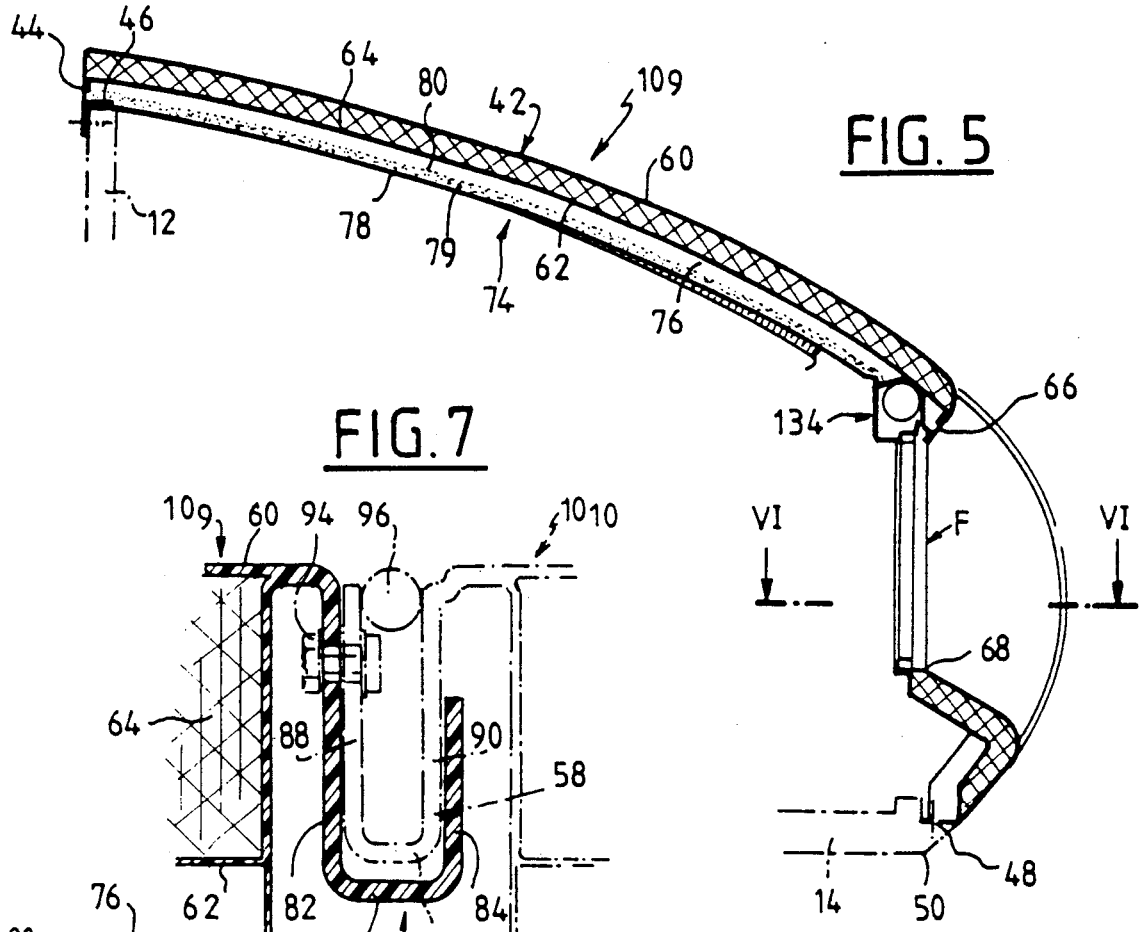
FIG. 5
FIG. 7
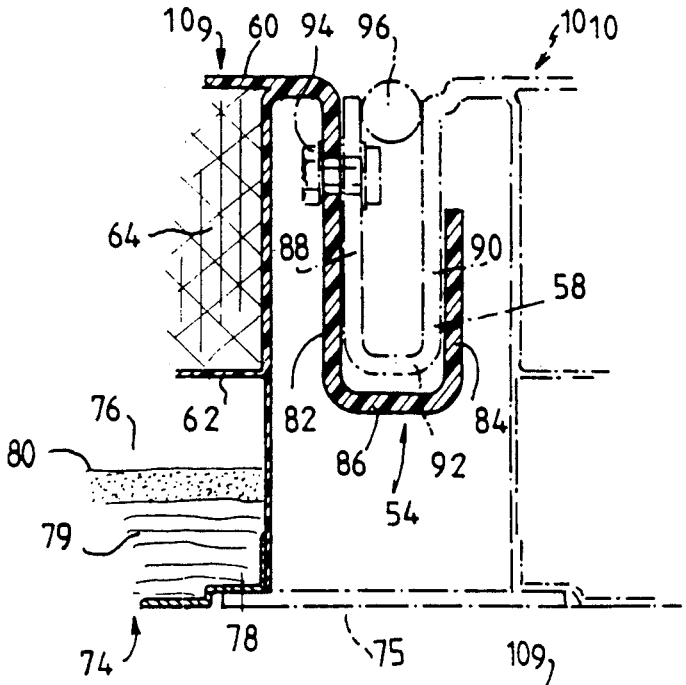
FIG. 6
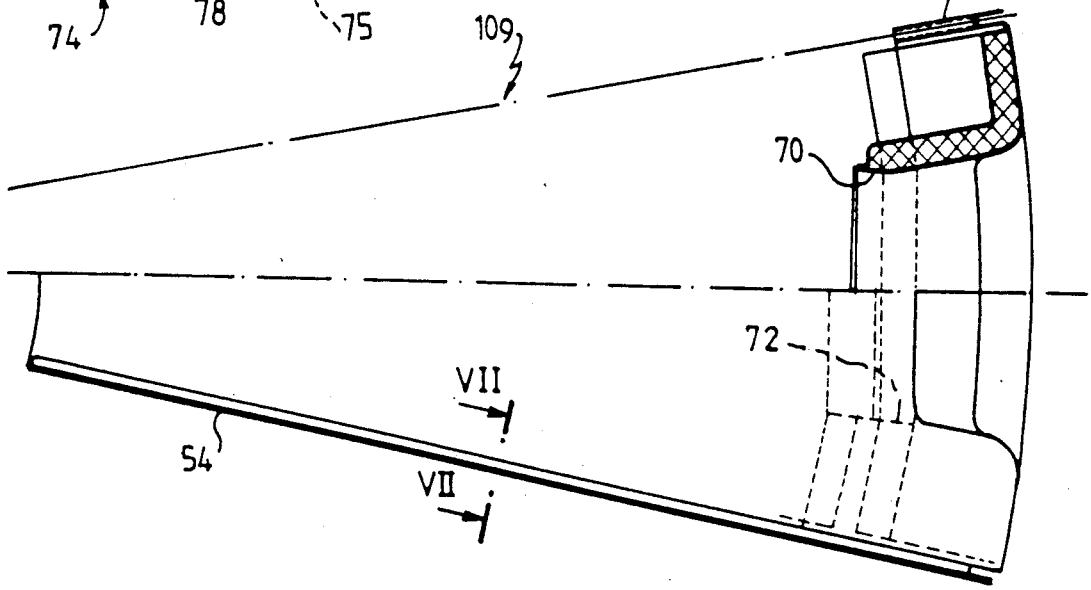

PREFABRICATED HOUSE INCLUDING MOLDED ELEMENTS

The invention relates to a prefabricated house.

BACKGROUND OF THE INVENTION

Prefabricated houses are built from standardized elements which are manufactured in a factory, and in particular from wall elements and roof elements. These elements are then transported to the building site to be put into place and assembled in accordance with a preestablished plan.

Since such prefabricated houses are generally made of the same materials as traditional houses, their component elements are heavy and difficult to move, and this requires powerful lifting and transport means.

In addition, such standardized elements are designed to be put into place in a well-defined arrangement and they offer no flexibility in use.

Prefabricated houses are also known which include molded elements, e.g. made of materials of the fiber/resin type. However, these prefabricated houses are constructed using the same principles as prefabricated houses that make use of traditional materials, and they thus suffer from the same drawbacks.

A particular object of the invention is to avoid these drawbacks of prior prefabricated houses.

SUMMARY OF THE INVENTION

To this end, the present invention provides a prefabricated house of the type including molded elements, which house, is constituted by a low dome built up from an assembly of radial molded elements disposed adjacent to one another, with each element including an outside wall constituting both the side wall and the roof of the house and delimited by a top edge for connection to a central frame, a bottom edge for connection to a floor slab, and two side edges for assembling to two corresponding side edges belonging to two adjacent elements.

This provides a novel type of prefabricated house which is essentially constituted by radial elements that are easily transported to the building site and which are then easily put into place and assembled to one another.

Thus, in horizontal projection, the component elements of the prefabricated house of the invention define circular sectors, thus making it possible to dispose them in a large number of combinations in order to satisfy user requirements.

Advantageously, each of the radial elements is formed as a single piece by molding a composite fiber/resin material, thereby making it possible to obtain an element which is light in weight, easy to transport, and then easy to put into place on the building site.

In a preferred embodiment of the invention, elements are selected from solid-wall elements, elements having a wall fitted with a window, and elements having a wall fitted with a door.

In the preferred embodiment of the invention, the top and bottom edges of each element are in the form of circular arcs, whereas the side edges are in the form of fractions of an ellipse, such that the resulting dome has the form of a portion of an ellipsoid of revolution whose axis of revolution corresponds to the short axis of the ellipse.

Advantageously, the side edges whereby two adjacent elements are assembled to each other include a channel section female edge and a male edge of complementary profile. This makes the elements particularly easy to assemble to one another.

Preferably, the side edges of two adjacent elements are held together by nuts and bolts disposed at intervals, with a seal being additionally applied in the zone where a male edge is assembled to a female edge.

The invention also provides for a house which comprises elements having two male assembly edges and elements having two female assembly edges, with such elements being disposed in alternating manner. It is then possible to place the elements having female assembly edges in the appropriate locations on the ground, and then to put the elements having male assembly edges into place.

Advantageously, the wall of each element is of the sandwich type comprising an outer skin and an inner skin which are interconnected via a honeycomb and/or foam structure.

Advantageously, the wall of each element is lined on the inside in the ceiling region by plaster board lined with staff.

In a preferred embodiment of the invention, the prefabricated house includes a concrete substructure constituted by a generally circular floor slab of concrete having a hollow cylindrical shaft, likewise made of concrete, erected thereon, with the top edge of each element being fixed to the shaft and the bottom edge of each element being fixed to the concrete slab.

Advantageously, the cylindrical shaft may have a terrace formed at the top thereof and may include a multiplicity of doors leading to rooms delimited by internal partitions.

BRIEF DESCRIPTION OF THE DRAWINGS

In the following description given purely by way of example, reference is made to the accompanying drawings, in which:

FIG. 5 is a vertical section through an element fitted with a window and forming a portion of the prefabricated house shown in FIGS. 1 to 3;

FIG. 6 is a half plan and a half section through the element shown in FIG. 5, with the half section being taken on line VI—VI of FIG. 5; and FIG. 7 is a cross-section, on a larger scale, on line VII—VII of FIG. 6.

DETAILED DESCRIPTION

Figure 1:
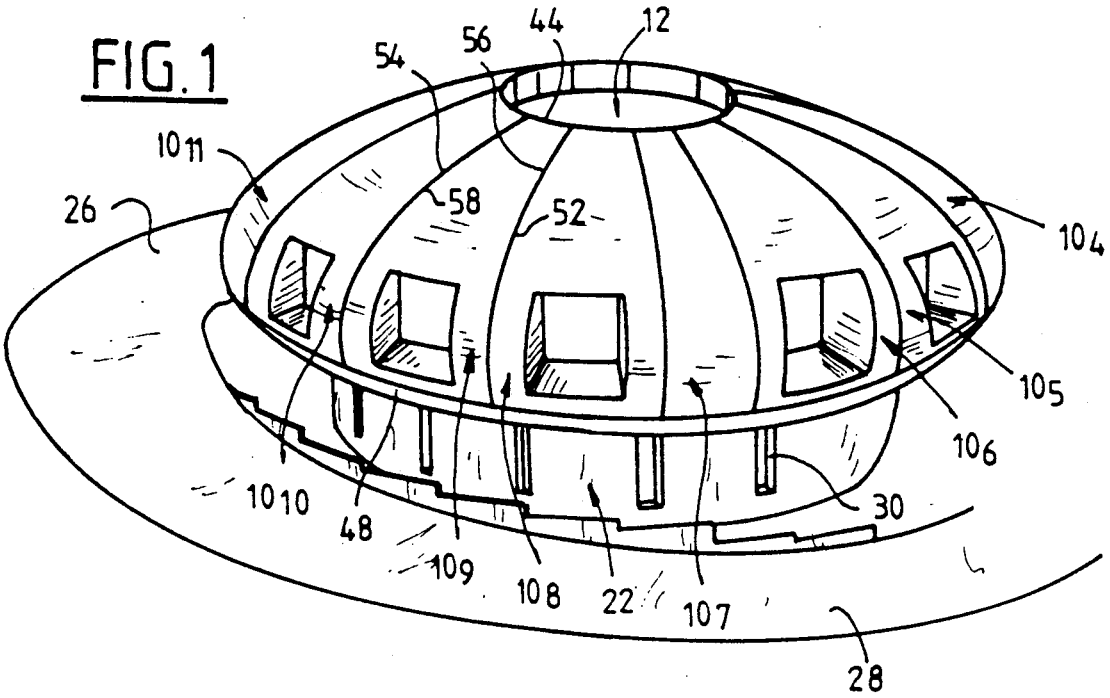
FIG. 1 is a perspective view of a prefabricated house in accordance with the invention.
Figure 2:
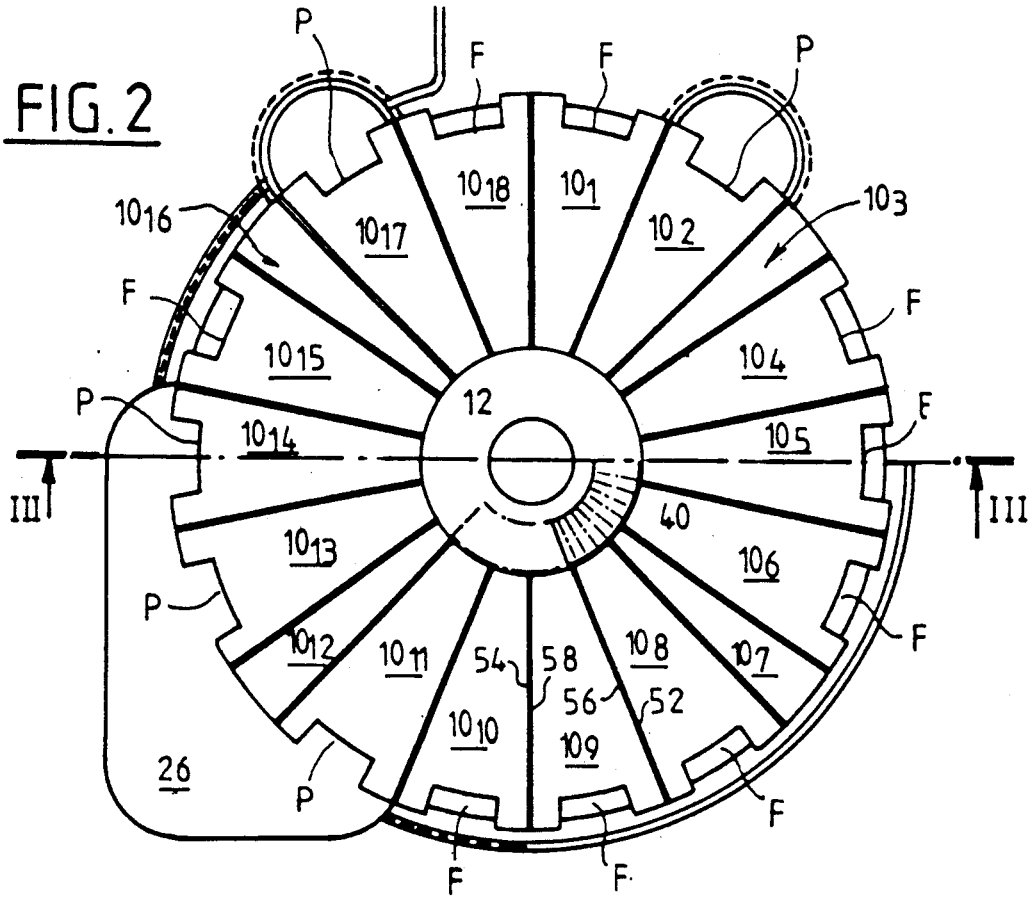
FIG. 2 is a plan view of the prefabricated house shown in FIG. 1.
Figure 3:
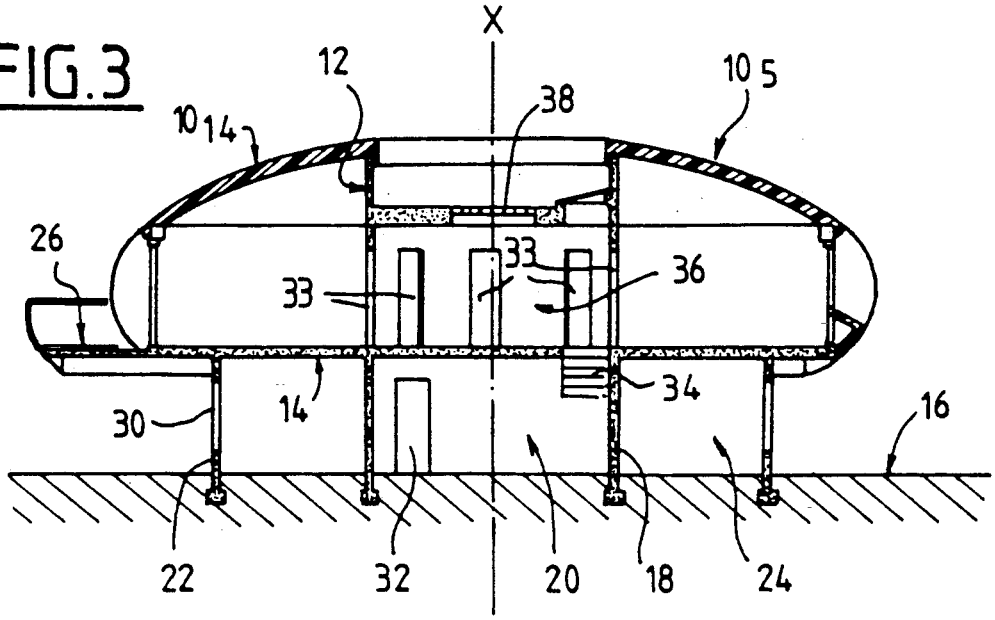
FIG. 3 is a section view on line III—III of FIG. 2.

The prefabricated house shown in FIGS. 1 to 3 comprises, in this example, eighteen prefabricated elements $\mathbf{10}_1$ to $\mathbf{10}_{18}$ in this example, eighteen prefabricted elements $\mathbf{10}_1$ to $\mathbf{10}_{18}$ each formed by molding and suitable for being disposed radially about a central frame 12 constituted by a concrete cylindrical shaft centered on a vertical axis XX (FIG. 3). The concrete shaft 12 is erected on a concrete floor slab 14 which is generally circular in shape.

The radial elements $\mathbf{10}_1$ to $\mathbf{10}_{18}$ are adjacent and together they constitute a low dome, e.g. having a height of less than 4 meters, in the form of a body of revolution about the axis XX.

In the embodiment shown, the slab 14 is raised above the level of the ground 16 (FIG. 3) by foundations comprising a first generally cylindrical wall 18 delimiting an inner cage 20, and a second generally cylindrical wall 22 centered about the axis XX and delimiting a generally annular basement room 24 which may be used as a garage, for example.

The slab 14 is partially extended by a terrace 26 which communicates with the basement level 16 via sloping ground 28 (FIG. 1).

The cylindrical wall 22 includes a garage door (not shown in the drawings) and a multiplicity of windows 30. The wall 18 includes an opening for a door 32 giving access to the inner room 20. A stair 34 provides access to a lobby 36 formed inside the shaft 12 above the slab 14. The top of the lobby 16 is delimited by a slab 38 constituting a terrace and accessible via a stair 40 (FIG. 2). The terrace thus forms a circular opening in the central portion of the dome. The shaft 12 includes a plurality of doors 33 providing communication between the lobby 36 and the rooms of the house.

In a variant, the floor slab 14 could rest directly on the ground, without a basement being provided.

The concrete substructure constituted by the slab 14 and the shaft 12 serves as a support for the elements $10_1$ to $10_{18}$, each of which is formed as a single piece by molding a composite fiber/resin material, and each of which is disposed radially about the shaft 12 centered on the axis XX.

In the example shown, elements $10_1$, $10_4$, $10_5$, $10_6$, $10_8$, $10_9$, $10_{10}$, $10_{15}$, and $10_{18}$ are all elements of the same type comprising a wall fitted with a window F, and the elements $10_2$, $10_{11}$, $10_{13}$, $10_{14}$, and $10_{17}$ are elements in which the wall is fitted with a door P. Finally, the elements $10_3$, $10_7$, $10_{12}$, and $10_{16}$ are elements in which the wall is solid, i.e. has no opening. Seen from above, i.e. in horizontal projection (FIG. 2) the elements $10_1$ to $10_{18}$ form eighteen adjacent angular sectors. The elements fitted with windows occupy a segment having the same angle as the elements fitted with doors, and all of these sectors occupy an angle of 22.5°. In contrast, the solid wall elements $10_3$, $10_7$, $10_{12}$, and $10_{16}$ each occupy half that angle, i.e. 11.25°.

Odd numbered elements, i.e. elements $10_1$, $10_3$, $10_5$, $10_7$, $10_9$, $10_{11}$, $10_{13}$, $10_{15}$, and $10_{17}$ are elements having female assembly edges, whereas even numbered elements, i.e. $10_2$, $10_4$, $10_6$, $10_8$, $10_{10}$, $10_{12}$, $10_{14}$, $10_{16}$, and $10_{18}$ are elements having male assembly edges, as described below.

All of the elements $10_1$ to $10_{18}$ are manufactured in accordance with the same principles, and by way of example, there follows a description of the structure of element $10_9$ which is an element fitted with a window and having female type assembly edges.

The element $10_9$ comprises a continuous, rounded outside wall 42 constituting both a portion of the side wall and of the roof of the house, the vertical section through said wall (FIG. 5) having an outside shape which corresponds to a portion of an ellipse whose short axis is vertical and coincides with the axis XX, such that the shape of the dome constitutes a portion of an ellipsoid of revolution. The wall 42 is delimited by a top edge 44 in the form of a circular arc having a downwardly directed rim for bearing against the annular top edge 46 of the shaft 12. The bottom of the wall 42 is delimited by a bottom edge 48 having an inwardly directed rim for bearing against and being fixed to a position close to the outer edge 50 of the slab 14.

The wall 42 is also limited by two side edges 52 and 54 each of which runs from the top edge 44 to the bottom edge 48. The side edges 52 and 54 are intended to be assembled respectively to a side edge 56 of the element $10_8$ and to a side edge 58 of the element $10_{10}$. The edges 52 and 54 are both of the female type and the edges 56 and 58 are both of the male type.

The wall 42 is made of a sandwich type material comprising an outer skin 60 and an inner skin 62 both made of a composite fiber/resin material, e.g. a polyester resin reinforced with glass fibers, and the skins 60 and 62 are interconnected by a honeycomb structure 64, which is advantageously filled with an insulating foam. In a variant, the skins 60 and 62 could be interconnected either solely by a honeycomb structure, or else solely by a foam. The wall 42 delimits two horizontal edges 66 and 68 and two vertical edges 70 and 72 around an opening for receiving a window F.

The inside of that portion of the wall which corresponds to the roof, i.e. extending from the top edge 44 to the top edge 66 of the window and between the two side edges 52 and 54, is lined with a false ceiling 74 disposed at a distance from the inside skin 62 in order to leave an air space 76. The false ceiling 74 comprises a board of plaster 78 facing the inside of the house and a back lining of staff 79. A layer 80 of glass fibers and mortar is projected onto the staff 79 in order to improve the sound-damping properties of the house.

Both assembly edges 52 and 54 of the element $10_9$ have similar female type profiles. For example, the edge 54 (FIG. 7) has two flanges 82 and 84 interconnected by a web 86 in order to constitute a substantially channel-section member. Correspondingly, the male type assembly edge 58 of the element $10_{10}$ has a channel-section member with two flanges 88 and 90 interconnected by a web 92 (FIG. 7).

In order to build a prefabricated house as shown in the accompanying figures, and once the substructure has been built, it is necessary merely to put the female type elements, i.e. the odd numbered elements ($10_1$, $10_3$, etc.) into their final locations, with the top edge of each element bearing against the shaft 12 and with the bottom edge of each element bearing against the slab 14. Thereafter, the elements having male type assembly edges, i.e. the even numbered elements ($10_2$, $10_4$, etc.) can be put into place in the gaps between pairs of adjacent elements. When the elements having male assembly edges are put into place, their edges are automatically received in the female type assembly edges.

Thereafter, in order to fix the elements together finally, nut and bolt assemblies 94 (FIG. 7) are put into place, in the present example, through pairs of aligned holes disposed at intervals along the flange 82 of edge 54 and the flange 88 of edge 58. Once all of the nuts and bolts are in place, it is preferable to install a seal 96 in the slot of the channel section member constituted by the male assembly edges, e.g. assembly edge 58.

Naturally, the top and bottom edges of each element are also fixed to the concrete substructure by any appropriate means, e.g. by means of bolts.

When all the elements have been put into place, partitions are put into place within the annular space delimited by the shaft 12 and the set of elements $10_1$ to $10_{18}$. These partitions are preferably made of composite fiber/resin material and they may be disposed radially or non-radially relative to the axis XX, extending all the way up to the ceiling, or possibly only part of the way. In a variant, the partitions may be put into place at the same time as the elements instead of being put into place subsequently. In addition, the false ceilings 74 are interconnected in pairs by add-on plates 75, as shown in FIG. 7.

Figure 4:
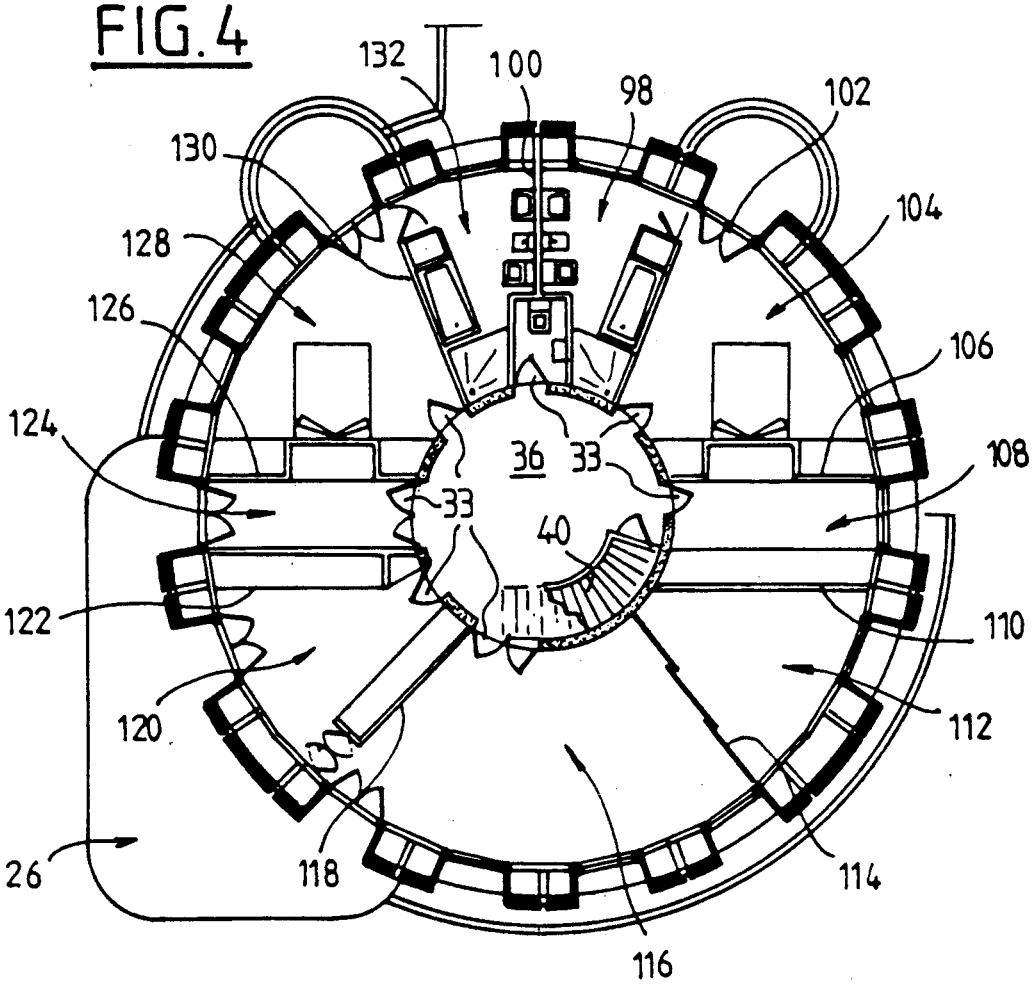
FIG. 4 is a ground plan of the prefabricated house shown in FIGS. 1 to 3.

As shown in FIG. 4, the prefabricated house comprises, in this example: a bathroom 98 delimited by two partitions 100 and 102; a bedroom 104 delimited by partition 102 and another partition 106; a linen room 108 delimited by the partition 106 and another partition 110; a reception room 112 delimited by the partition 110 and a moving partition 114; a dining room 116 delimited by the moving partition 114 and a partition 118; a kitchen 120 delimited by the partition 118 and another partition 122; a hall 124 delimited by a partition 122 and a partition 126; a bedroom 128 delimited by the partition 126 and another partition 130; and finally another bathroom 132 delimited by the partition 130 and the partition 100.

Advantageously, the said partitions may form storage chests or cupboards. Similarly, storage chests or cupboards may be provided in the walls of one or more of the elements $\mathbf{10}_1$ to $\mathbf{10}_{18}$.

Advantageously, as shown in FIG. 5, a casing element 134 is fixed inside each of the elements where the ceiling meets the side wall in order to provide a space suitable for containing service ducting.

The invention makes it possible to build a wide range of houses from a small number of different types of element, by selecting different elements and by selecting the way in which they are disposed relative to one another.

I claim:

1. A prefabricated house of the type comprising adjacent, radial, molded elements which are assembled to one another to form a low dome, wherein the house comprises a central support structure (12) in the form of a hollow cylindrical shaft erected on a floor slab and forming a circular centrally enclosed area, and wherein each molded element comprises an external wall made of a sandwich of composite material and constituting both side wall and roof of the house, said outside wall being delimited by a top edge for attachment to an upper edge of the central support structure, a bottom edge for attachment to the floor slab, and two side edges for assembling to two corresponding side edges belonging to two adjacent mounted elements.

2. A prefabricated house according to claim 1, wherein each molded element is formed as a single piece by molding a composite fiber/resin material.

3. A prefabricated house according to claim 1, wherein the molded elements include elements in which the wall is solid , elements in which the wall is fitted with a window, and elements in which the wall is fitted with a door.

4. A prefabricated house according to claim 3, wherein the elements in which the wall is fitted with a window and the elements in which the wall is fitted with a door define sectors occupying a given angle, whereas the elements in which the wall is solid define sectors occupying one half that angle.

5. A prefabricated house according to claim 1, wherein the top edge and the bottom edge of each element is in the form of a circular arc, whereas the side edges are in the form of a fraction of an ellipse, such that the final dome is in the form of a portion of an ellipsoid of revolution about the short axis of the ellipse.

6. A prefabricated house according to claim 1, wherein the wall of each element is lined on the inside in a ceiling region by a board of plaster coated with staff.

7. A prefabricated house according to claim 1, including a substructure of concrete comprising said floor slab which is generally circular and which has a hollow cylindrical concrete shaft erected thereon, with the top edge of each element being fixed to the shaft and the bottom edge of each element being fixed to the slab.

8. A prefabricated house according to claim 7, wherein the cylindrical shaft has a terrace at the top and also includes doors serving rooms delimited by internal partitions.

9. A prefabricated house according to claim 1, wherein the assembly side edges of two adjacent elements comprise a channel section female edge and a male edge of complementary section, and wherein the side edges of two adjacent elements are held together by nut and bolt assemblies, with a seal being applied over the assembly zone between a male edge and a female edge.

* * * * *